US008471200B2

(12) United States Patent
Campuzano et al.

(10) Patent No.: US 8,471,200 B2
(45) Date of Patent: Jun. 25, 2013

(54) MASS SPECTROMETER

(75) Inventors: Iain Campuzano, Manchester (GB); Kevin Giles, Cheshire (GB); Chris Hughes, Manchester (GB)

(73) Assignee: Micromass UK Limited, Manchester (GB)

( * ) Notice: Subject to any disclaimer, the term of this patent is extended or adjusted under 35 U.S.C. 154(b) by 584 days.

(21) Appl. No.: 12/528,203

(22) PCT Filed: Feb. 25, 2008

(86) PCT No.: PCT/GB2008/000629

§ 371 (c)(1),
(2), (4) Date: Jul. 29, 2010

(87) PCT Pub. No.: WO2008/102163

PCT Pub. Date: Aug. 28, 2008

(65) Prior Publication Data

US 2011/0127416 A1 Jun. 2, 2011

Related U.S. Application Data

(60) Provisional application No. 60/895,554, filed on Mar. 19, 2007.

(30) Foreign Application Priority Data

Feb. 23, 2007 (GB) ..... 0703578.5

(51) Int. Cl.
*H01J 49/04* (2006.01)

(52) U.S. Cl.
CPC ..... *H01J 49/0481* (2013.01)
USPC ..... 250/288

(58) Field of Classification Search
USPC ..... 250/288
See application file for complete search history.

(56) References Cited

U.S. PATENT DOCUMENTS

| | | | |
|---|---|---|---|
| 4,023,398 | A | 5/1977 | French et al. |
| 4,137,750 | A | 2/1979 | French et al. |
| 4,148,196 | A | 4/1979 | French et al. |
| 4,885,076 | A | 12/1989 | Smith et al. |
| 5,406,079 | A | 4/1995 | Kato |

(Continued)

FOREIGN PATENT DOCUMENTS

| | | |
|---|---|---|
| EP | 0123552 | 10/1984 |
| EP | 0373835 | 6/1990 |

(Continued)

OTHER PUBLICATIONS

Schultz, Jocely C. et al; Mass Determination of Megadalton-DNA Electrospray Ions Using Charge Detection Mass Spectrometry, Focus: Synthetic Polymers, 1998 American Society for Mass Spectrometry, pp. 305-313.

(Continued)

*Primary Examiner* — Jack Berman
(74) *Attorney, Agent, or Firm* — Diederiks & Whitlaw, PLC

(57) ABSTRACT

A mass spectrometer is disclosed comprising a sampling cone and a cone-gas cone wherein, in use, sulphur hexa fluoride ('$SF_6$') is supplied as a cone gas to the annulus between the cone-gas cone and the sampling cone in order to improve the transmission of high molecular mass ions passing through the sampling cone into and through subsequent stages of the mass spectrometer.

19 Claims, 6 Drawing Sheets

U.S. PATENT DOCUMENTS

| | | | | |
|---|---|---|---|---|
| 6,147,345 | A * | 11/2000 | Willoughby | 250/288 |
| 7,759,643 | B2 * | 7/2010 | Lloyd et al. | 250/288 |
| 2004/0217280 | A1 | 11/2004 | Schneider et al. | |
| 2004/0238754 | A1 | 12/2004 | Baranov et al. | |
| 2007/0158546 | A1 | 7/2007 | Lock et al. | |

FOREIGN PATENT DOCUMENTS

| | | |
|---|---|---|
| GB | 1400333 | 7/1975 |
| JP | 06-130037 | 6/1994 |
| JP | 2004-28763 | 1/2004 |
| JP | 2005-172472 | 6/2005 |

OTHER PUBLICATIONS

Notification of Reasons for Rejection for Japanese Application No. 2009-550321, dated Mar. 31, 2011.

PCT International Search Report form ISA/220&210 for Application No. PCT/GB2008/000629, dated Nov. 5, 2009.

Search and Examination Report for GB Applicaiton 0803384.7, dated Jun. 23, 2008.

* cited by examiner

MASS SPECTROMETER

CROSS REFERENCE TO RELATED APPLICATIONS

This application is the National Stage of International Application No. PCT/GB2008/000629, filed Feb. 25, 2008, which claims priority to and benefit of United Kingdom Patent Application No.0703578.5, filed Feb. 23, 2007 and U.S. Provisional Patent Application Ser. No. 60/895,554 filed Mar. 19, 2007. The entire contents of these applications are incorporated herein by reference.

BACKGROUND OF THE INVENTION

The present invention relates to a mass spectrometer and a method of mass spectrometry. The preferred embodiment relates to the use or supply of sulphur hexafluoride ("$SF_6$") as the cone gas to a sampling cone and/or a cone-gas cone of a mass spectrometer.

The efficient transmission of ions from an atmospheric pressure ion source to the vacuum stages of a conventional mass spectrometer is dependent upon a combination of gas flow dynamic effects and the application of electric fields which are maintained throughout the various vacuum stages of the mass spectrometer. Nitrogen gas is commonly used as a carrier gas, or as the background gas, for Atmospheric Pressure Ionization ("API") ion sources. Nitrogen acts as a cooling/desolvating medium for ions laving a relatively wide range of mass to charge ratios. However, if very high mass ions are desired to be mass analysed then nitrogen has been shown to be a relatively inefficient cooling and/or desolvation gas for such high mass ions over the relatively short ion residence times that ions are typically present in a vacuum stage of a mass spectrometer. Also, ions of very high mass are relatively unsusceptible to the drag due to bulk movement or flow of nitrogen gas molecules and consequently are not effectively drawn or directed by the flow of nitrogen gas.

It is known to attempt to address this problem by increasing significantly the pressure of the nitrogen gas in order to provide more collisions, thereby improving the desolvation and/or cooling of the analyte ions. However, this approach has not been found to be particularly satisfactory for ions with very high masses.

It is therefore desired to provide an improved mass spectrometer.

SUMMARY OF THE INVENTION

According to an aspect of the present invention there is provided a method of mass spectrometry comprising:

providing a mass spectrometer comprising a sampling cone and/or a cone-gas cone; and supplying a first gas as a cone gas or curtain gas to the sampling cone and/or the cone-gas cone, or supplying a first gas as an additive to a cone gas or curtain gas which is supplied to the sampling cone and/or the cone-gas cone, wherein the first gas comprises sulphur hexafluoride ("$SF_6$").

According to an aspect of the present invention there is provided a method of mass spectrometry comprising:

providing a mass spectrometer comprising a sampling cone and/or a cone-gas cone; and supplying a first gas as a cone gas or curtain gas to the sampling cone and/or the cone-gas cone, or supplying a first gas as an additive to a cone gas or curtain gas which is supplied to the sampling cone and/or the cone-gas cone, wherein the first gas is selected from the group consisting of:

(i) xenon; (ii) uranium hexafluoride ("$UF_4$"); (iii) isobutane ("$C_4H_{10}$"); (iv) argon; (v) krypton; (vi) perfluoropropane ("$C_3F_8$"); (vii) hexafluoroethane ("$C_2F_6$"); (viii) hexane ("$C_6H_{14}$"); (ix) benzene ("$C_6H_6$"); (x) carbon tetrachloride ("$CCl_4$"); (xi) iodomethane ("$CH_3I$"); (xii) diiodomethane ("$CH_2I_2$"); (xiii) carbon dioxide ("$CO_2$"); (xiv) nitrogen dioxide ("$NO_2$"); (xv) sulphur dioxide ("$SO_2$"); (xvi) phosphorus trifluoride ("$PF_3$"); and (xvii) disulphur decafluoride ("$S_2F_{10}$").

The method preferably further comprises supplying the first gas as an additive to a cone gas or curtain gas which is supplied to the sampling cone and/or the cone-gas cone, wherein the cone gas is selected from the group consisting of: (i) nitrogen; (ii) argon; (iii) xenon; (iv) air; (v) methane; and (vi) carbon dioxide.

According to an embodiment the method further comprises either:

(a) heating the first gas prior to supplying the first gas to the sampling cone and/or the cone-gas cone; and/or (b) heating the sampling cone and/or the cone-gas cone.

The first gas and/or the sampling cone and/or the cone-gas cone are preferably heated to a temperature selected from the group consisting of: (i)>30° C.; (ii)>40° C.; (iii)>50° C.; (iv)>60° C.; (v)>70° C.; (vi)>80° C.; (vii)>90° C.; (viii)>100° C.; (ix)>110° C.; (x)>120° C.; (xi)>13.0° C.; (xii)>140° C.; (xiii)>150° C.; (xiv)>160° C.; (xv)>170° C.; (xvi)>180° C.; (xvii)>190° C.; (xviii)>200° C.; (xix)>250° C.; (xx)>300° C.; (xxi)>350° C.; (xxii)>400° C.; (xxiii)>450° C.; and (xxiv)>500° C.

The mass spectrometer preferably comprises an ion source, a cone-gas cone which surrounds a sampling cone, a first vacuum chamber, a second vacuum chamber separated from the first vacuum chamber by a differential pumping aperture and wherein the method further comprises:

supplying the first gas to the sampling cone and/or the cone-gas cone so that at least some of the first gas interacts with analyte ions passing through the sampling cone and/or the cone-gas cone into the first vacuum chamber.

The ion source is preferably selected from the group consisting of: (i) an Atmospheric Pressure ion source; (ii) an Electrospray ionisation ("ESI") ion source; (iii) an Atmospheric Pressure Chemical Ionisation ("APCI") ion source; (iv) an Atmospheric Pressure Ionisation ("API") ion source; (v) a Desorption Electrospray Ionisation ("DESI") ion source; (vi) an Atmospheric Pressure Matrix Assisted Laser Desorption Ionisation ion source; and (vii) an Atmospheric Pressure Laser Desorption and Ionisation ion source.

The method preferably further comprises:

(i) maintaining the first vacuum chamber at a pressure selected from the group consisting of: (i)<1 mbar; (ii) 1-2 mbar; (iii) 2-3 mbar; (iv) 3-4 mbar; (v) 4-5 mbar; (vi) 5-6 mbar; (vii) 6-7 mbar; (viii) 7-8 mbar; (ix) 8-9 mbar; (x) 9-10 mbar; and (xi)>10 mbar; and/or (ii) maintaining the second vacuum chamber at a pressure selected from the group consisting of: (i)<$1\times10^{-3}$ mbar; (ii) $1\text{-}2\times10^{-3}$ mbar; (iii) $2\text{-}3\times10^{-3}$ mbar; (iv) $3\text{-}4\times10^{-3}$ mbar; (v) $4\text{-}5\times10^{-3}$ mbar; (vi) $5\text{-}6\times10^{-3}$ mbar; (vii) $6\text{-}7\times10^{-3}$ mbar; (viii) $7\text{-}8\times10^{-3}$ mbar; (ix) $8\text{-}9\times10^{-3}$ mbar; (x) $9\text{-}10\times10^{-3}$ mbar; (xi) $1\text{-}2\times10^{-2}$ mbar; (xii) $2\text{-}3\times10^{-2}$ mbar; (xiii) $3\text{-}4\times10^{-2}$ mbar; (xiv) $4\text{-}5\times10^{-2}$ mbar; (xv) $5\text{-}6\times10^{-2}$ mbar; (xvi) $6\text{-}7\times10^{-2}$ mbar; (xvii) $7\text{-}8\times10^{-2}$ mbar; (xviii) $8\text{-}9\times10^{-2}$ mbar; (xix) $9\text{-}10\times10^{-2}$ mbar; (xx) 0.1-0.2 mbar; (xxi) 0.2-0.3 mbar; (xxii) 0.3-0.4 mbar; (xxiii) 0.4-0.5 mbar; (xxiv) 0.5-0.6 mbar; (xxv) 0.6-0.7 mbar; (xxvi) 0.7-0.8 mbar; (xxvii) 0.8-0.9 mbar; (xxxviii) 0.9-1 mbar; and (xxix)>1 mbar.

According the preferred embodiment the method further comprises supplying the first gas to the sampling cone and/or the cone-gas cone at a flow rate selected from the group consisting of: (i)<10 l/hr; (ii) 10-20 l/hr; (iii) 20-30 l/hr; (iv) 30-40 l/hr; (v) 40-50 l/hr; (vi) 50-60 l/hr; (vii) 60-70 l/hr; 70-80 l/hr; (ix) 80-90 l/hr; (x) 90-100 l/hr; (xi) 100-110 l/hr; (xii) 110-120 l/hr; (xiii) 120-130 l/hr; (xiv) 130-140 l/hr; (xv) 140-150 l/hr; and (xvi)>150 l/hr.

According to another aspect of the present invention there is provided a mass spectrometer comprising a sampling cone and/or a cone-gas cone; and a supply device arranged and adapted to supply, in use, a first gas as a cone gas or curtain gas which is supplied to the sampling cone and/or the cone-gas cone, or as an additive to a cone gas or curtain gas which is supplied to the sampling cone and/or the cone-gas cone, wherein the first gas comprises sulphur hexafluoride ("$SF_6$").

According to another aspect of the present invention there is provided a mass spectrometer comprising a sampling cone and/or a cone-gas cone; and a supply device arranged and adapted to supply a first gas as a cone gas or curtain gas which is supplied to the sampling cone and/or the cone-gas cone, or as an additive to a cone gas or curtain gas which is supplied to the sampling cone and/or the cone-gas cone, wherein the first gas is selected from the group consisting of: (i) xenon; (ii) uranium hexafluoride ("$UF_6$"); (iii) isobutane ("$C_4H_{10}$"); (iv) argon; (v) krypton; (vi) perfluoropropane ("$C_3F_8$"); (vii) hexafluoroethane ("$C_2F_6$"); (viii) hexane ("$C_6H_{14}$"); (ix) benzene ("$C_6H_6$"); (x) carbon tetrachloride ("$CCl_4$"); (xi) iodomethane ("$CH_3I$"); (xii) diiodomethane ("$CH_2I_2$"); (xiii) carbon dioxide ("$CO_2$"); (xiv) nitrogen dioxide ("$NO_2$"); (xv) sulphur dioxide ("$SO_2$"); (xvi) phosphorus trifluoride ("$PF_3$"); and (xvii) disulphur decafluoride ("$S_2F_{10}$").

The mass spectrometer preferably further comprises:

(a) a device for heating the first gas prior to supplying the first gas to the sampling cone and/or the cone-gas cone; and/or (b) a device for heating the sampling cone and/or the cone-gas cone.

The mass spectrometer preferably comprises an ion source, a cone-gas cone which surrounds a sampling cone, a first vacuum chamber, a second vacuum chamber separated from the first vacuum chamber by a differential pumping aperture and wherein the supply device is arranged and adapted to supply, in use, the first gas to the sampling cone and/or the cone-gas cone so that at least some of the first gas interacts, in use, with analyte ions passing through the sampling cone and/or the done-gas cone into the first vacuum chamber.

The ion source is preferably selected from the group consisting of: (i) an Atmospheric Pressure ion source; (ii) an Electrospray ionisation ("ESI") ion source; (iii) an Atmospheric Pressure Chemical Ionisation ("APCI") ion source; (iv) an Atmospheric Pressure Ionisation ("API") ion source; (v) a Desorption Electrospray Ionisation ("DESI") ion source; (vi) an Atmospheric Pressure Matrix Assisted Laser Desorption Ionisation ion source; and (vii) an Atmospheric Pressure Laser Desorption and Ionisation ion source.

The mass spectrometer, preferably further comprises:

(a) an ion guide arranged in the second vacuum chamber or in a subsequent vacuum chamber downstream of the second vacuum chamber; and/or (b) a mass filter or mass analyser arranged in the second vacuum chamber or in a subsequent vacuum chamber downstream of the second vacuum chamber; and/or (c) an ion trap or ion trapping region arranged in the second vacuum chamber or in a subsequent vacuum chamber downstream of the second vacuum chamber; and/or (d) an ion mobility spectrometer or separator and/or a Field Asymmetric Ion Mobility Spectrometer arranged in the second vacuum chamber or in a subsequent vacuum chamber downstream of the second vacuum chamber; and/or (e) a collision, fragmentation or reaction device selected from the group consisting of: (i) a Collisional Induced Dissociation ("CID") fragmentation device; (ii) a Surface Induced Dissociation ("SID") fragmentation device; (iii) an Electron Transfer Dissociation fragmentation device; (iv) an Electron Capture Dissociation fragmentation device; (v) an Electron Collision or Impact Dissociation fragmentation device; (vi) a Photo Induced Dissociation ("PID") fragmentation device; (vii) a Laser Induced Dissociation fragmentation device; (viii) an infrared radiation induced dissociation device; (ix) an ultraviolet radiation induced dissociation device; (x) a nozzle-skimmer interface fragmentation device; (xi) an in-source fragmentation device; (xii) an ion-source Collision Induced Dissociation fragmentation device; (xiii) a thermal or temperature source fragmentation device; (xiv) an electric field induced fragmentation device; (xv) a magnetic field induced fragmentation device; (xvi) an enzyme digestion or enzyme degradation fragmentation device; (xvii) an ion-ion reaction fragmentation device; (xviii) an ion-molecule reaction fragmentation device; (xix) an ion-atom reaction fragmentation device; (xx) an ion-metastable ion reaction fragmentation device; (xxi) an ion-metastable molecule reaction fragmentation device; (xxii) an ion-metastable atom reaction fragmentation device; (xxiii) an ion-ion reaction device for reacting ions to form adduct or product ions; (xxiv) an ion-molecule reaction device for reacting ions to form adduct or product ions; (xxv) an ion-atom reaction device for reacting ions to form adduct or product ions; (xxvi) an ion-metastable ion reaction device for reacting ions to form adduct or product ions; (xxvii) an ion-metastable molecule reaction device for reacting ions to form adduct or product ions; and (xxviii) an ion-metastable atom reaction device for reacting ions to form adduct or product ions; and/or (f) a mass analyser arranged in the second vacuum chamber or in a subsequent vacuum chamber downstream of the second vacuum chamber, the mass analyser being selected from the group consisting of: (i) a quadrupole mass analyser; (ii) a 2D or linear quadrupole mass analyser; (iii) a Paul or 3D quadrupole mass analyser; (iv) a Penning trap mass analyser; (v) an ion trap mass analyser; (vi) a magnetic sector mass analyser; (vii) Ion Cyclotron Resonance ("ICR") mass analyser; (viii) a Fourier Transform Ion Cyclotron Resonance ("FTICR") mass analyser; (ix) an electrostatic or orbitrap mass analyser; (x) a Fourier Transform electrostatic or orbitrap mass analyser; (xi) a Fourier Transform mass analyser; (xii) a Time of Flight mass analyser; (xiii) an orthogonal acceleration Time of Flight mass analyser; and (xiv) a linear acceleration Time of Flight mass analyser.

According to an embodiment an ion guide may be provided in the second vacuum chamber and a further ion guide may be provided in a third vacuum chamber arranged immediately downstream from the second vacuum chamber and separated therefrom by a differential pumping aperture which separates the second vacuum chamber from the third vacuum chamber.

According to an aspect of the present invention there is provided a mass spectrometer comprising:

an atmospheric pressure ion source;

a first differential pumping aperture arranged between an atmospheric pressure stage and a first vacuum stage;

a second differential pumping aperture arranged between the first vacuum stage and a second vacuum stage; and a supply device arranged and adapted to supply, in use, sulphur hexafluoride ("$SF_6$") or disulphur decafluoride ("$S_2F_{10}$") to a region immediately upstream and/or a region immediately downstream of the first differential pumping aperture and/or to the first vacuum stage.

According to the preferred embodiment either:

(i) the first vacuum stage is pumped by a rotary pump or a scroll pump; and/or (ii) the second vacuum stage is pumped by a turbomolecular, pump or a diffusion pump; and/or (iii) the first vacuum stage is maintained at a pressure in the range 1-10 mbar; and/or (iv) the second vacuum stage is maintained at a pressure in the range $10^{-3}$-$10^{-2}$ mbar or 0.01-0.1 mbar or 0.1-1 mbar or >1 mbar; and/or (v) the first differential pumping aperture comprises a sampling cone; and/or (vi) the second differential pumping aperture comprises an extraction lens; and/or (vii) an ion guide comprising a plurality of elongated electrodes and/or a plurality of electrodes having apertures through which ions are transmitted in use is provided in the second vacuum stage; and/or (viii) analyte ions pass, in use, from the first differential pumping aperture to the second differential pumping aperture without being guided by an ion guide comprising a plurality of elongated electrodes and/or a plurality of electrodes having apertures through which ions are transmitted in use.

The mass spectrometer preferably further comprises a cone-gas cone surrounding the first differential pumping aperture, wherein the supply device is arranged and adapted to supply, in use, sulphur hexafluoride ("$SF_6$") or disulphur decafluoride ("$S_2F_{10}$") to one or more gas outlets or an annular gas outlet which substantially encloses and/or surrounds the first differential pumping aperture, wherein analyte ions passing through the first differential pumping aperture interact with the sulphur hexa fluoride.

According to another aspect of the present invention there is provided a method of mass spectrometry comprising:

providing an atmospheric pressure ion source, a first differential pumping aperture arranged between an atmospheric pressure stage and a first vacuum stage and a second differential pumping aperture arranged between the first vacuum stage and a second vacuum stage; and supplying sulphur hexafluoride ("$SF_6$") or disulphur decafluoride ("$S_2F_{10}$") to a region immediately upstream and/or a region immediately downstream of the first differential pumping aperture and/or to the first vacuum stage.

According to the preferred embodiment the method further comprises either:

(i) pumping the first vacuum stage by a rotary pump or a scroll pump; and/or (ii) pumping the second vacuum stage by a turbomolecular pump or a diffusion pump; and/or (iii) maintaining the first vacuum stage at a pressure in the range 1-10 mbar; and/or (iv) maintaining the second vacuum stage at a pressure in the range $10^{-3}$-$10^{-2}$ mbar or 0.01-0.1 mbar or 0.1-1 mbar or >1 mbar; and/or (v) wherein the first differential pumping aperture comprises a sampling cone; and/or (vi) wherein the second differential pumping aperture comprises an extraction lens; and/or (vii) providing an ion guide comprising a plurality of elongated electrodes and/or a plurality of electrodes having apertures through which ions are transmitted in the second vacuum stage; and/or (viii) passing analyte ions from the first differential pumping aperture to the second differential pumping aperture without being guided by an ion guide comprising a plurality of elongated electrodes and/or a plurality of electrodes having apertures through which ions are transmitted.

The method preferably further comprises providing a cone-gas cone surrounding the first differential pumping aperture, the method further comprising:

supplying the sulphur hexafluoride ("$SF_6$") or disulphur decafluoride ("$S_2F_{10}$") to one or more gas outlets or an annular gas outlet which substantially encloses and/or surrounds the first differential pumping aperture, wherein analyte ions passing through the first differential pumping aperture interact with the sulphur hexafluoride.

According to the preferred embodiment sulphur hexafluoride ("$SF_6$") is preferably used as a cone gas or curtain gas, and as a carrier gas particularly when the mass spectrometer is operated in a mode of operation wherein ions having relatively large masses and/or mass to charge ratios are desired to be mass analysed. Sulphur hexafluoride has been found to be a more efficient cooling and/or desolvation gas than nitrogen for high mass ions. Also, ions of very high mass have been found to be more susceptible to the drag due to the bulk movement or flow of sulphur hexafluoride gas molecules and consequently are more effectively drawn or directed by the flow of sulphur hexafluoride gas.

According to an embodiment the preferred mass spectrometer made be operated in a mode of operation wherein analyte ions having a mass greater than 10000, 20000, 30000, 40000, 50000, 60000, 70000, 80000, 90000, 100000, 200000, 300000, 400000, 500000, 600000, 700000, 800000, 900000 or 1000000 Daltons, or a mass to charge ratio greater than or equal to 1000, 2000, 3000, 4000, 5000, 6000, 7000, 8000, 9000, 10000, 11000, 12000, 13000, 14000, 15000, 16000, 17000, 18000, 19000, 20000, 25000 or 30000 may be arranged and/or desired to be mass analysed by the mass spectrometer.

In this mode of operation the analyte ions which are desired to be mass analysed may have a maximum mass of 10000, 20000, 30000, 40000, 50000, 60000, 70000, 80000, 90000, 100000, 200000, 300000, 400000, 500000, 600000, 700000, 800000, 900000 or 1000000 Daltons, or a maximum mass to charge ratio equal to 1000, 2000, 3000, 4000, 5000, 6000, 7000, 8000, 9000, 10000, 11000, 12000, 13000, 14000, 15000, 16000, 17000, 18000, 19000, 20000, 25000 or 30000.

According to the preferred embodiment of the present invention sulphur hexafluoride is delivered to the atmospheric pressure stage or the sampling cone and/or cone-gas cone of a mass spectrometer. According to other embodiments sulphur hexafluoride may be delivered to the first vacuum stage and/or the second vacuum stage of a mass spectrometer.

Sulphur hexafluoride may according to one embodiment be localised substantially at the first vacuum orifice or differential pumping aperture. The gas may be drawn into the vacuum system and may carry ions with it.

According to the preferred embodiment the transmission and detection of charged ions having a high molecular weight may be improved significantly by using sulphur hexafluoride as the cone gas and/or curtain gas and/or the carrier gas for a mass spectrometer.

The use of sulphur hexafluoride as a cone gas and/or curtain gas and/or carrier gas has been found to have a number of benefits. Firstly, using sulphur hexafluoride as the cone gas or curtain gas preferably enables ions to be cooled more rapidly than when compared with using nitrogen as a carrier gas. This preferably helps to remove or reduce streaming effects which would otherwise occur when large ions pass through the gas. As a result, ions can be controlled and/or confined more effectively through the use of electric fields. Secondly, using sulphur hexafluoride as the cone gas or curtain gas preferably improves the efficiency of the desolvation process, that is, the removal of residual water and/or other solvent molecules attached to the analyte ions, which preferably thereby improves the mass spectral resolution for ions having relatively high masses or mass to charge ratios.

Other less preferred embodiments are contemplated wherein the cone gas or curtain gas or carrier gas may comprise xenon, uranium hexafluoride ($UF_6$), isobutane ($C_4H_{10}$), argon, polymers mixed with isobutane, polyatomic gases, carbon dioxide ($CO_2$), nitrogen dioxide ($NO_2$), sulphur dioxide ($SO_2$), phosphorus trifluoride ($PF_3$), krypton, perfluoropropane ($C_3F_8$), hexafluoroethane ($C_2F_6$) and other refrigerant compounds.

Other embodiments are contemplated wherein the gases which may be used are liquid at room temperature. The liquid may be heated so that a heated cone gas or curtain gas or carrier gas is preferably supplied. Volatile molecules such as hexane ($C_6H_{14}$), benzene ($C_6H_6$), carbon tetrachloride ($CCl_4$), disulphur decafluoride ($S_2F_{10}$), iodomethane ($CH_3I$) and diiodomethane ($CH_2I_2$) may be used as pure cone gases or as additives to other cone gases.

BRIEF DESCRIPTION OF THE DRAWINGS

Various embodiments of the present invention will now be described, by way of example only, and with reference to the accompanying drawings in which.

DETAILED DESCRIPTION OF THE PREFERRED EMBODIMENTS

Figure 1:
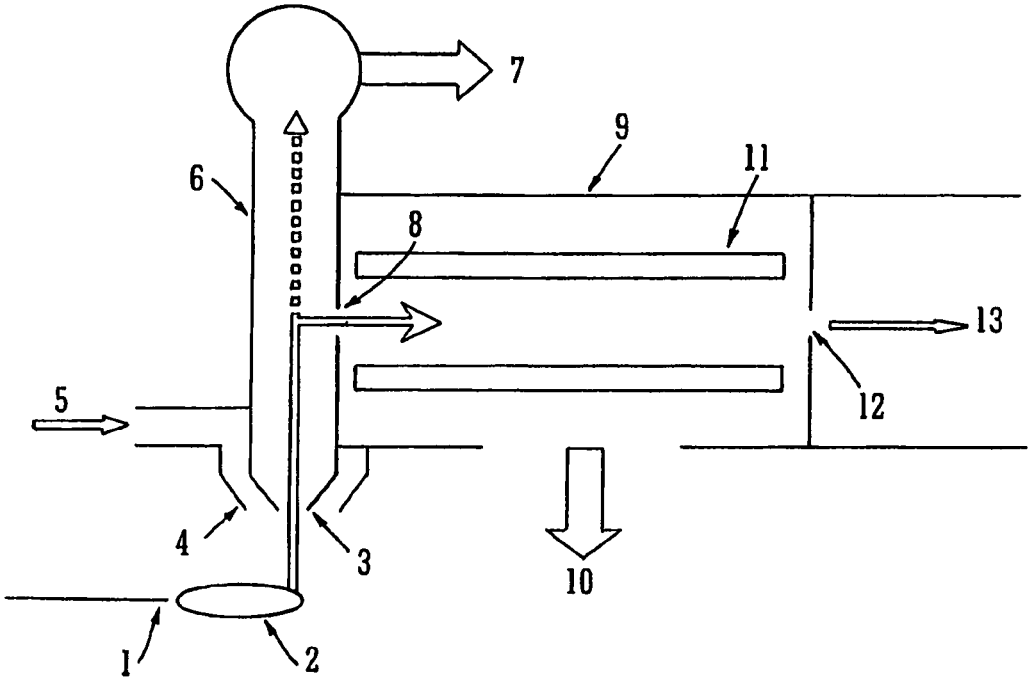
FIG. 1 shows the initial vacuum stages of a mass spectrometer comprising a sampling cone and a cone-gas cone at the entrance to the first vacuum chamber.

A preferred embodiment of the present invention will now be described with reference to FIG. 1 which shows the initial vacuum stages of a mass spectrometer. An Electrospray capillary 1 which forms part of an Electrospray ion source is shown which emits, in use, an ion plume 2. Ions and neutral gas molecules are drawn through a sampling cone 3 into the first vacuum chamber 6 of a mass spectrometer. A cone-gas cone 4 surrounds the sampling cone 3 and a cone gas or curtain gas 5 is preferably supplied to the cone-gas cone 4. Neutral gas molecules continue through the first vacuum chamber 6 which is evacuated by a rough pump 7 such as a rotary pump or scroll pump. The rough pump, rotary pump or scroll pump serves to provide the backing pressure to a second vacuum chamber 9 which is pumped by a fine pump such as a turbomolecular pump or diffusion pump. The term "backing pressure" refers to the pressure in the first vacuum chamber 6. Ions are diverted in an orthogonal direction by an electric field or extraction lens into the second vacuum chamber 9. An ion guide 11 is preferably provided in the second vacuum chamber 9 to guide ions through the second vacuum chamber 9 and to transmit ions to subsequent lower pressure vacuum chambers. The second vacuum chamber 9 is preferably pumped by a turbomolecular pump or a diffusion pump 10. Ions exiting the second vacuum chamber 9 preferably pass through a differential pumping aperture 12 into subsequent stages of the mass spectrometer.

Various embodiments of the present invention will now be illustrated with reference to the mass analysis of a chaperone protein GroEL. The protein GroEL is a dual-ringed tetradecamer and has a nominal mass of approximately 800 kDa. A chaperone protein is a protein that assists in the folding or unfolding of other macromolecular structures but which does not occur in the macromolecular structure when the macromolecular structure is performing its normal biological function. The protein was mass analysed using a mass spectrometer wherein sulphur hexafluoride ($SF_6$, MW ~146) was supplied as a cone gas or curtain gas 5. The resulting mass spectra were compared with mass spectra which were obtained in a conventional manner wherein nitrogen gas was used as a cone gas or curtain gas.

The experimental results which are presented below were acquired using a tandem or hybrid quadrupole Time of flight mass spectrometer equipped with an Electrospray ionisation source. The mass spectrometer comprises six vacuum chambers. Ions pass via a sampling cone into a first vacuum chamber and then pass into a second vacuum chamber. An ion guide is located in a second vacuum chamber. The ions then pass from the second vacuum chamber into a third vacuum chamber which comprises a quadrupole rod set ion guide or mass filter. The ions then pass into a fourth vacuum chamber which comprises a gas collision chamber. Ions exiting the fourth vacuum chamber then pass through a short fifth vacuum chamber before passing into a sixth vacuum chamber which houses a Time of Flight mass analyser. The ions are then mass analysed by the Time of Flight mass analyser.

Argon gas was supplied to the gas collision chamber at a pressure of $7\times10^{-2}$ mbar. The GroEL sample was provided at a concentration of 3 μM in an aqueous solution of ammonium acetate.

The sample of GroEL was infused into the mass spectrometer under operating conditions which were approximately optimised for high molecular weight mass analysis. The backing pressure (i.e. the pressure in the first vacuum chamber 6 as shown in FIG. 1) was maintained in the range 5 to 9 mbar and the cone-gas cone and the sampling cone of the mass spectrometer were maintained at a potential of 175V. The cone-gas cone and the sampling cone comprise two co-axial stainless steel cones which are in direct contact with each other and which are maintained at the same potential. Measurements were made initially without introducing any cone gas or curtain gas into the sampling cone of the mass spectrometer.

To test the effect of using sulphur hexafluoride as a cone gas or curtain gas, a sulphur hexafluoride cylinder was connected to a cone gas flow controller. Sulphur hexafluoride was then delivered in a measured and accurate manner as a cone gas or curtain gas and the resultant effect was measured. The cone gas flow rate of the sulphur hexafluoride was varied between 0 L/hour and 150 L/hour and mass spectra were obtained at various different flow rates. Measurements were made at a backing pressure in the range 1 to 2 mbar both with and without sulphur hexafluoride being introduced into the mass spectrometer as a cone gas or curtain gas.

When the mass spectrometer was operated in a mode wherein the backing pressure was increased to 5-9 mbar then the collision energy of the gas collision cell located in the fourth vacuum chamber was maintained at 50V in order to improve the desolvation of ions, that is, the removal of any residual water molecules attached to the analyte ions.

When the mass spectrometer was operated according to the preferred embodiment with sulphur hexafluoride being supplied as a cone gas or curtain gas the analyte ions were observed to have relatively few water molecules attached to them. Consequently the collision energy of the gas collision cell located in the fourth vacuum chamber was reduced from 50V to 15V in order to prevent unwanted denaturing or unfolding and fragmentation of ions. The cone-gas cone and the sampling cone were maintained at a potential of 175V.

Figure 2A:
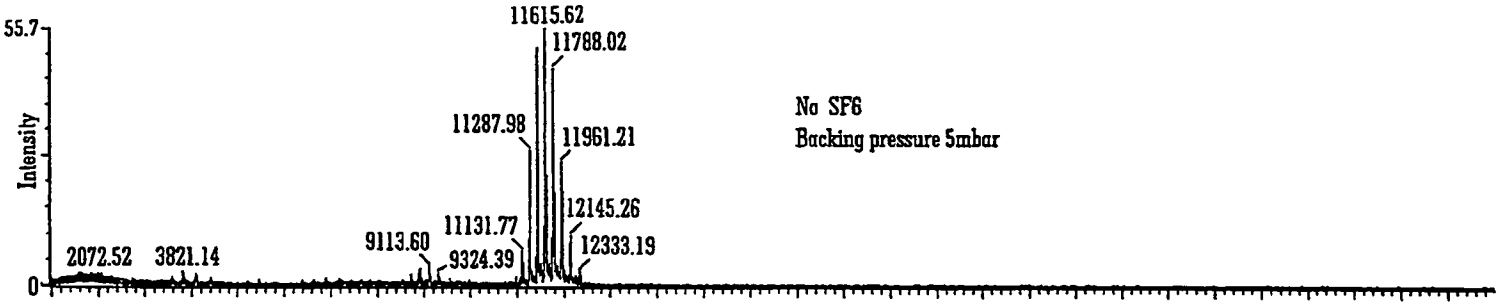
FIG. 2A shows a mass spectrum obtained conventionally at a backing pressure of 5 mbar without the use of sulphur hexafluoride as a cone gas or curtain gas.
Figure 2B:
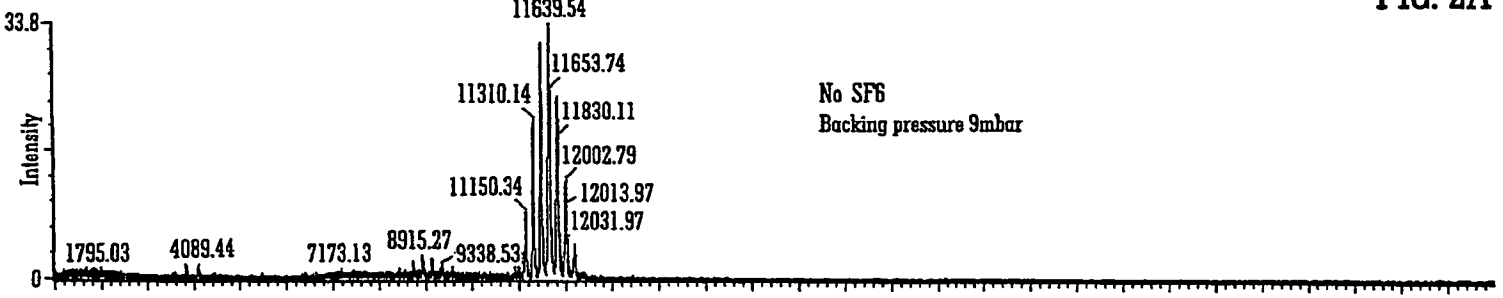
FIG. 2B shows a mass spectrum obtained conventionally at a raised backing pressure of 9 mbar without the use of sulphur hexafluoride as a cone gas or curtain gas and FIG. 2C shows a mass spectrum obtained according to a preferred embodiment of the present invention wherein sulphur hexafluoride was supplied as a cone gas or curtain gas at a rate of 60 mL/min and wherein the backing pressure was 1.16 mbar.

FIG. 2A shows a mass spectrum obtained conventionally without using sulphur hexafluoride as a cone gas or curtain gas and wherein the backing pressure (i.e. the pressure in the first vacuum chamber 6) was 5 mbar. FIG. 2B shows that when the backing pressure (i.e. the pressure in the first vacuum chamber 6) was increased to 9 mbar the intensity of the ion signal reduced significantly.

Figure 2C:
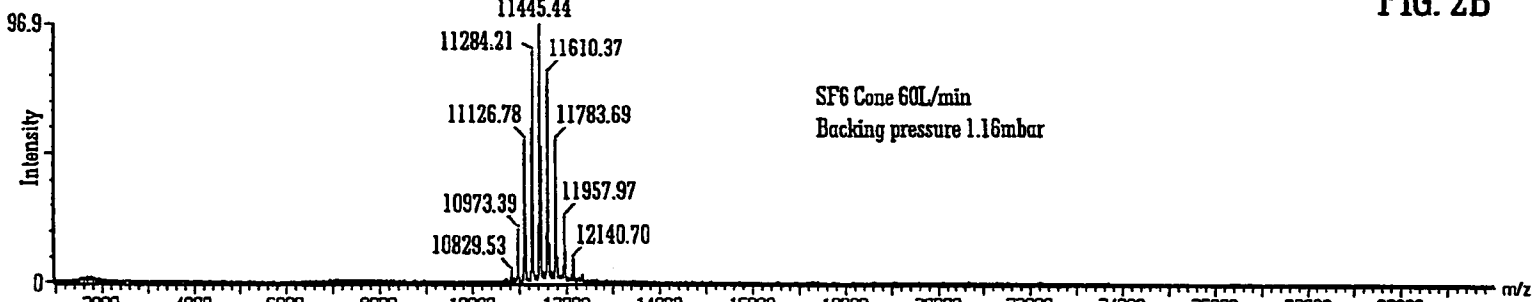

FIG. 2C shows a mass spectrum obtained according to an embodiment of the present invention wherein sulphur hexafluoride was supplied as a cone gas or curtain gas at a flow rate of 60 ml/min and wherein the backing pressure (i.e. the pressure in the first vacuum chamber 6) was maintained at a pressure of 1.16 mbar. As is apparent from FIG. 2C, the ion transmission increased by a factor of approximately ×2 when compared with operating the mass spectrometer in a conventional manner at an optimised backing pressure of 5 mbar as shown in FIG. 2A.

The resultant multiply charged peaks of GroEL as shown in the mass spectrum shown in FIG. 2C are also narrower and exhibit a lower measured mass than the corresponding peaks which are observed in the mass spectra shown in FIGS. 2A and 2B which were obtained conventionally. This suggests that sulphur hexafluoride has the advantageous effect of improving desolvation in the gas phase, that is, of removing any residual water molecules attached to the analyte ion.

Figure 3A:
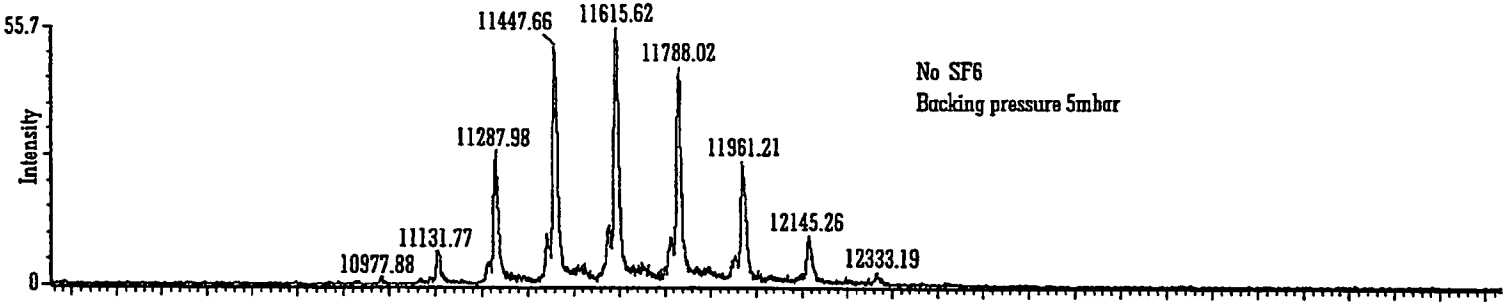
FIG. 3A shows in more detail the mass spectrum shown in FIG. 2A across the mass to charge ratio range 10000-14000.
Figure 3B:
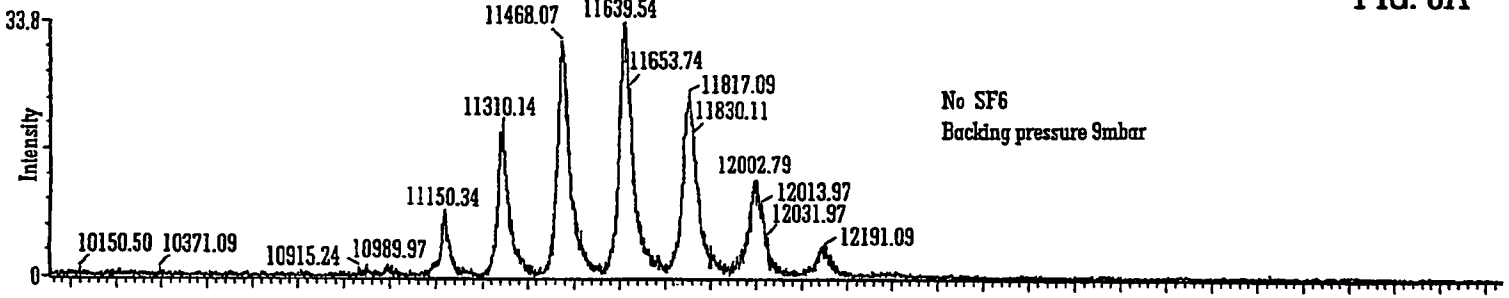
FIG. 3B shows in more detail the mass spectrum shown in FIG. 2B across the mass to charge ratio range 10000-14000 and FIG. 3C shows in more detail the mass spectrum shown in FIG. 2C across the mass to charge ratio range 10000-14000.
Figure 3C:
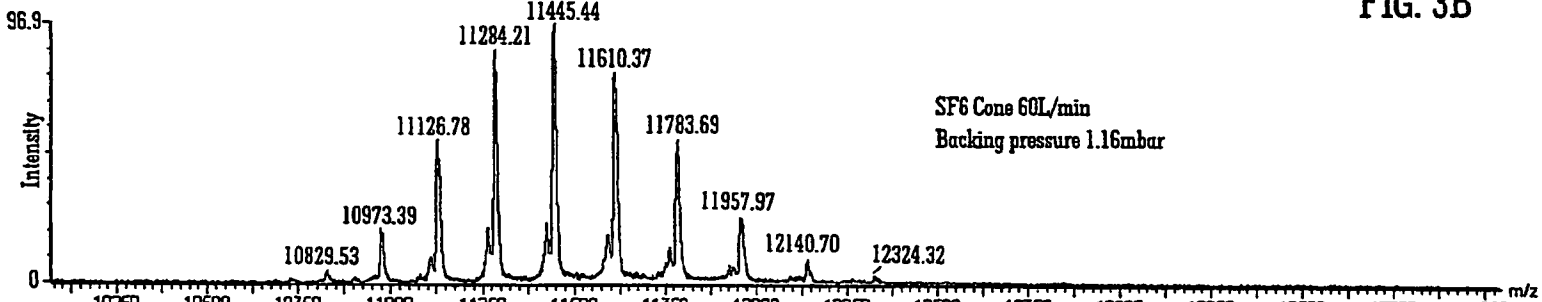

FIGS. 3A-3C show in greater detail the mass spectra shown in FIGS. 2A-2C over the mass range 10000-14000. As is apparent from FIG. 3C, the use of sulphur hexafluoride as the cone gas or curtain gas according to an embodiment of the present invention results in improved signal/noise and narrower improved desolvated peaks in the resulting mass spectrum.

FIGS. 4A-4D and FIGS. 5A-5D show the effect of varying the flow rate of the sulphur hexafluoride cone gas upon the ion transmission.

Figure 4A:
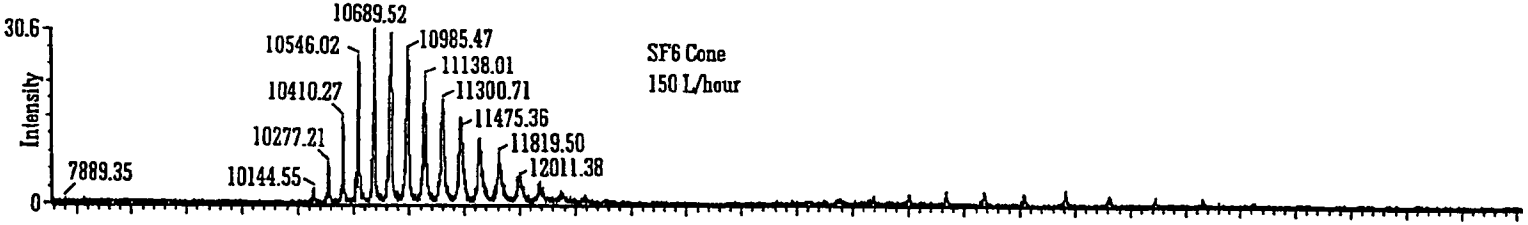
FIG. 4A shows a mass spectrum obtained according to an embodiment wherein sulphur hexafluoride was supplied as a cone gas or a curtain gas at a flow rate of 150 L/hr.
Figure 4B:
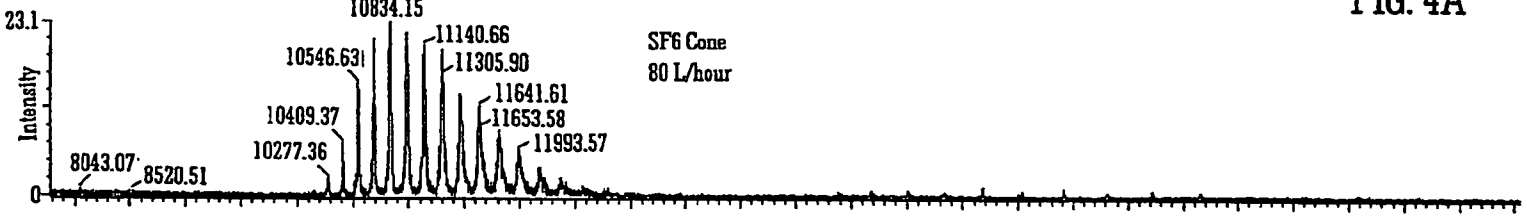
FIG. 4B shows a mass spectrum obtained according to an embodiment wherein sulphur hexafluoride was supplied as a cone gas or a curtain gas at a flow rate 80 L/hr.
Figure 4C:
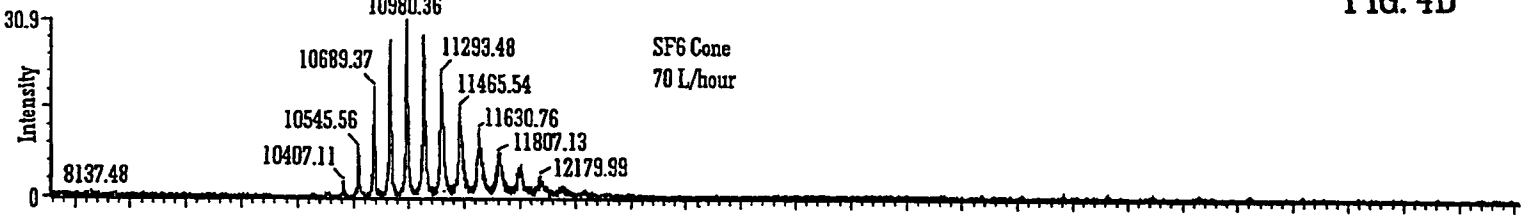
FIG. 4C shows a mass spectrum obtained according to an embodiment wherein sulphur hexafluoride was supplied as a cone gas or a curtain gas at a flow rate of 70 L/hr and FIG. 4D shows a mass spectrum obtained according to an embodiment wherein sulphur hexafluoride was supplied as a cone gas or a curtain gas at a flow rate of 60 L/hr.
Figure 4D:
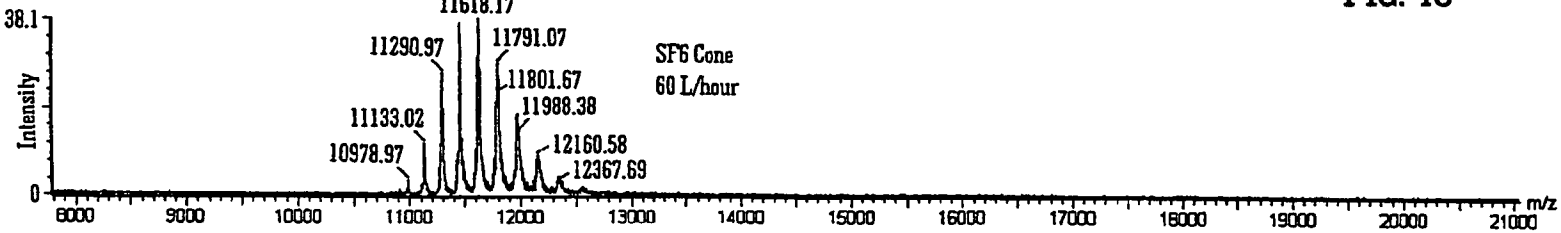

FIG. 4A shows a mass spectrum obtained according to an embodiment wherein sulphur hexafluoride was supplied at a flow rate of 150 L/hr. FIG. 4B shows a mass spectrum obtained according to an embodiment wherein sulphur hexafluoride was supplied at a flow rate of 80 L/hr. FIG. 4C shows a mass spectrum obtained according to an embodiment wherein sulphur hexafluoride was supplied at a flow rate of 70 L/hr. FIG. 4D shows a mass spectrum obtained according to an embodiment wherein sulphur hexafluoride was supplied at a flow rate of 60 L/hr.

Figure 5A:
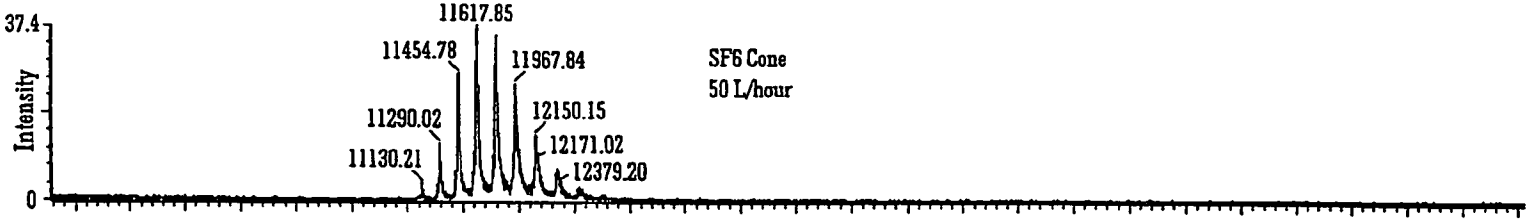
FIG. 5A shows a mass spectrum obtained according to an embodiment wherein sulphur hexafluoride was supplied as a cone gas or a curtain gas at a flow rate of 50 L/hr.
Figure 5B:
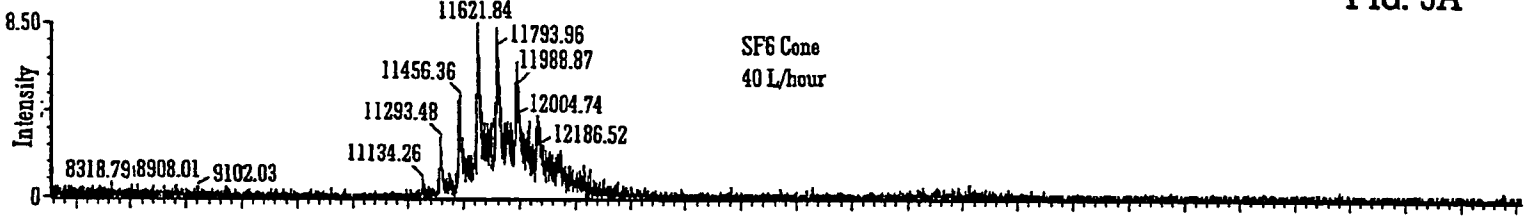
FIG. 5B shows a mass spectrum obtained according to an embodiment wherein sulphur hexafluoride was supplied as a cone gas or a curtain gas at a flow rate of 40 L/hr.
Figure 5C:
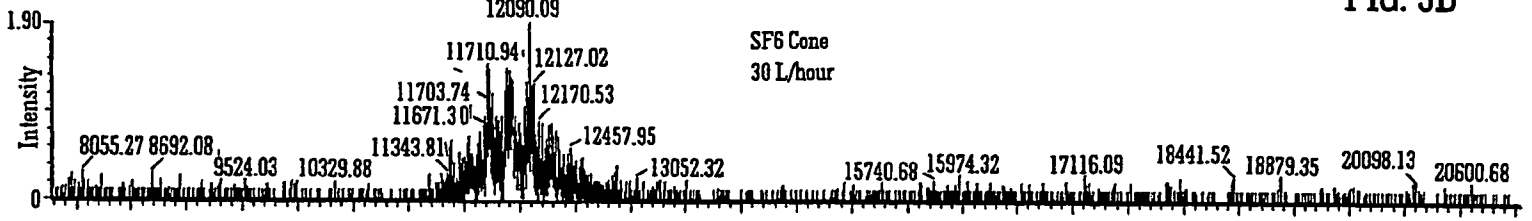
FIG. 5C shows a mass spectrum obtained according to an embodiment wherein sulphur hexafluoride was supplied as a cone gas or a curtain gas at a flow rate of 30 L/hr and FIG. 5D shows a mass spectrum obtained conventionally wherein no sulphur hexafluoride was supplied.
Figure 5D:
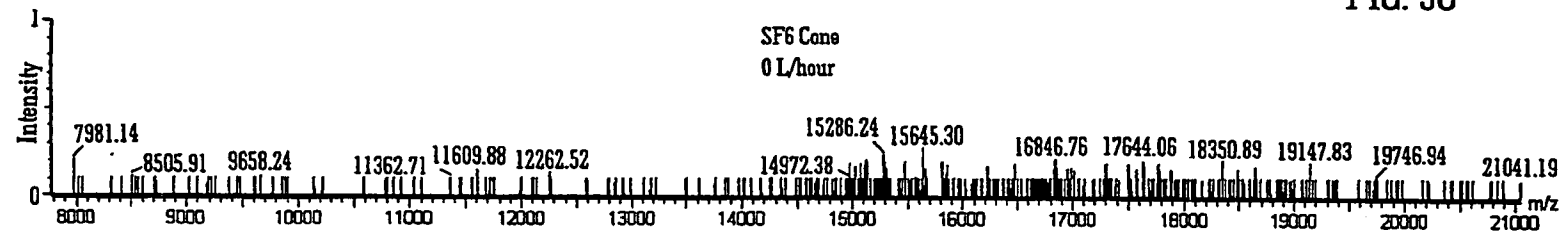

FIG. 5A shows a mass spectrum obtained according to an embodiment wherein sulphur hexafluoride was supplied at a flow rate of 50 L/hr. FIG. 5B shows a mass spectrum obtained according to an embodiment wherein sulphur hexafluoride was supplied at a flow rate of 40 L/hr. FIG. 5C shows a mass spectrum obtained according to an embodiment wherein sulphur hexafluoride was supplied at a flow rate of 30 L/hr. FIG. 5D shows a mass spectrum obtained conventionally wherein no sulphur hexafluoride was supplied.

The mass spectra as shown in FIGS. 4A-4D and 5A-5D demonstrate the effect of varying the flow rate of sulphur hexafluoride as a cone gas or curtain gas. A flow rate in the range 50-60 L/hour was found to be particularly preferred. If the flow rate was set too high (e.g. 150 L/hour) then peaks with higher charge states (lower mass to charge ratios) were observed. This suggests that under these conditions some denaturing, or unfolding, of the analyte ions is occurring. As a further consequence unwanted fragmentation of GroEL may occur.

It is apparent from FIGS. 4A-4D and 5A-5D that using sulphur hexafluoride as the cone gas or curtain gas significantly improves the transmission of high mass ions such as GroEL. The resultant multiply charged GroEL peaks also appear to be more efficiently desolvated.

According to an embodiment sulphur hexafluoride may be used as the sole cone gas or curtain gas. Alternatively, sulphur hexafluoride may be added as an additive to another cone gas or curtain gas. The use or addition of sulphur hexafluoride as a cone gas or curtain gas provides a better alternative to the known approach of attempting to raise the pressure of nitrogen carrier gas in order to improve the transmission and detection of large non-covalent biomolecules.

In addition to (or as an alternative to) using sulphur hexafluoride ($SF_6$) as a cone gas or curtain gas, or as an additive to another cone gas or curtain gas, other gaseous species may be used as a cone gas or curtain gas or as an additive to another cone gas or curtain gas in order to enhance transmission of high molecular weight species. According to other embodiments krypton or xenon may be used. According to further embodiments other polyatomic gases such as uranium hexafluoride ($UF_6$), iso-butane ($C_4H_{10}$), carbon dioxide ($CO_2$), nitrogen dioxide ($NO_2$), sulphur dioxide ($SO_2$), phosphorus trifluoride ($PF_3$), perfluoropropane ($C_3F_8$), hexafluoroethane ($C_2F_6$) or other refrigerant compounds may be used.

Another embodiment is contemplated wherein the cone-gas inlet may be modified to provide heated inlet lines thereby enabling the use of volatile molecules such as hexane ($C_6H_{14}$), benzene ($C_6H_6$), carbon tetrachloride ($CCl_4$), disulphur decafluoride ($S_2F_{10}$), iodomethane ($CH_3I$) or diiodomethane ($CH_2I_3$) either as pure cone gases or curtain gases or as additives to other cone gas or curtain gas species.

Figure 6A:
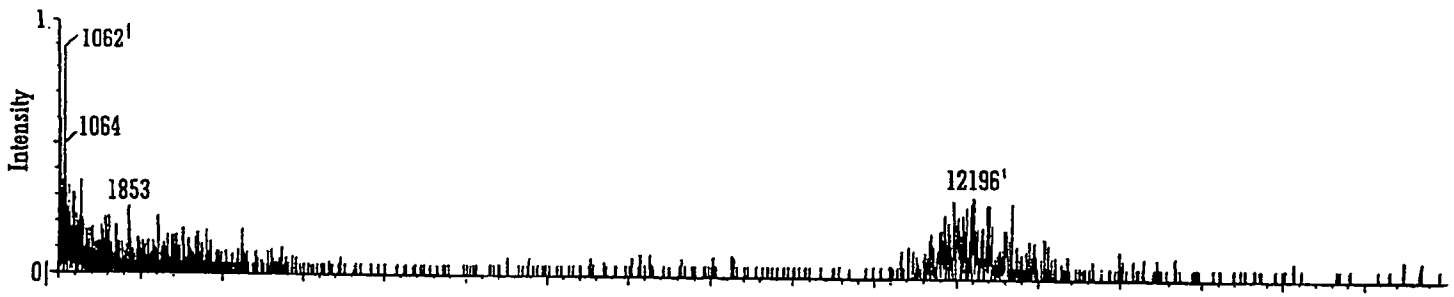
FIG. 6A shows a mass spectrum obtained conventionally wherein no sulphur hexafluoride was supplied.
Figure 6B:
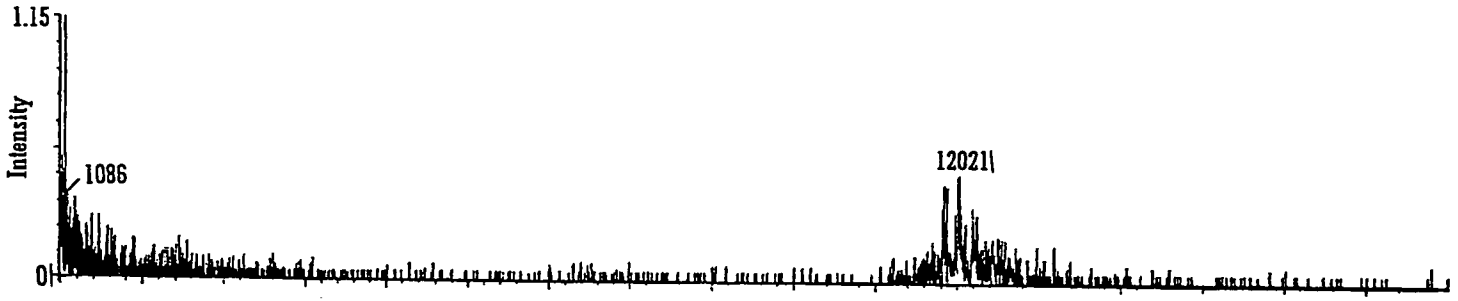
FIG. 6B shows a mass spectrum obtained according to a less preferred embodiment wherein sulphur hexafluoride was supplied to an ion guide housed in a second vacuum chamber of a mass spectrometer.
Figure 6C:
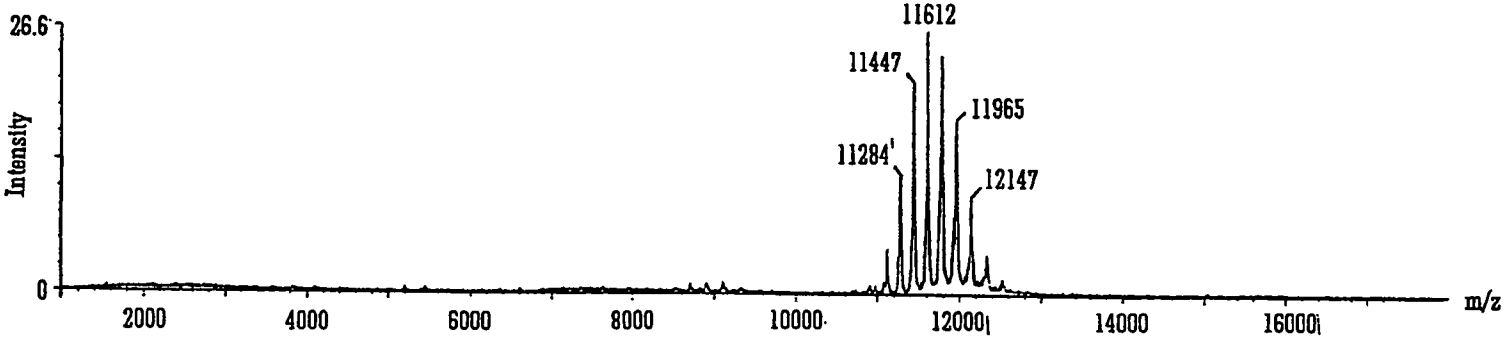
FIG. 6C shows a mass spectrum obtained according to a preferred embodiment wherein sulphur hexafluoride was supplied as a cone gas or a curtain gas.

FIGS. 6A-6C illustrate the significant benefit of supplying sulphur hexafluoride ($SF_6$) as a cone gas or curtain gas compared with adding the gas to the second vacuum chamber housing the first ion guide. This highlights the importance of the interactions between the heavy cone gas and the ionic species as they pass into the first vacuum chamber and then through the differential pumping aperture into the second vacuum chamber housing the first ion guide.

FIG. 6A shows a mass spectrum obtained conventionally wherein no sulphur hexafluoride ($SF_6$) gas was added. The pressure in the ion guide chamber (i.e. the second vacuum chamber) was approximately $2\times10^{-3}$ mbar.

FIG. 6B shows a mass spectrum obtained according to a less preferred embodiment wherein sulphur hexafluoride ($SF_6$) gas was added directly to the ion guide chamber (i.e. the second vacuum chamber) but was not supplied as a cone gas or curtain gas. The recorded pressure was $6.1\times10^{-3}$ mbar (as measured using a pirani gauge calibrated for nitrogen and uncorrected for sulphur hexafluoride ($SF_6$)).

FIG. 6C shows a mass spectrum obtained according to the preferred embodiment wherein sulphur hexafluoride ($SF_6$) was supplied as a cone gas or curtain gas. The pressure in the ion guide chamber (i.e. the second vacuum chamber) was recorded as being $2.5\times10^{-3}$ mbar (as measured using a pirani gauge calibrated for nitrogen and uncorrected for sulphur hexafluoride ($SF_6$)).

It is apparent from comparing the intensity of the mass spectrum shown in FIG. 6C obtained by supplying sulphur hexafluoride as a cone gas or curtain gas with the mass spectrum shown in FIG. 6B obtained by supplying sulphur hexafluoride direct to the second vacuum chamber housing the first ion guide that the ion signal was over 20 times more intense when sulphur hexafluoride was supplied as a cone gas or curtain gas than when sulphur hexafluoride was supplied directly to the second vacuum chamber. This highlights the particular advantage of using sulphur hexafluoride as a cone gas or curtain gas.

Although the present invention has been described with reference to preferred embodiments, it will be understood by those skilled in the art that various changes in form and detail may be made without departing from the scope of the present invention as defined by the accompanying claims.

The invention claimed is:

1. A method of mass spectrometry conducted with a sampling cone and a cone-gas cone comprising:

supplying, without ionization, a first gas as a cone gas or curtain gas to said sampling cone or said cone-gas cone, or supplying, without ionization, a first gas as an additive to a cone gas or curtain gas which is supplied to said sampling cone or said cone-gas cone, so that at least some of said first gas interacts with analyte ions passing through said sampling cone to cool or desolvate said analyte ions, wherein said first gas comprises sulphur hexafluoride ("$SF_6$").

2. A method as claimed in claim 1, further comprising supplying, without ionization, said first gas as an additive to a cone gas or curtain gas which is supplied to said sampling cone or said cone-gas cone, wherein said cone gas is selected from the group consisting of: (i) nitrogen; (ii) argon; (iii) xenon; (iv) air; (v) methane; and (vi) carbon dioxide.

3. A method as claimed in claim 1, further comprising either:

(a) heating said first gas prior to supplying said first gas to said sampling cone or said cone-gas cone; or (b) heating said sampling cone or said cone-gas cone, wherein said heating is to a temperature selected from the group consisting of: (i)>30° C.; (ii)>40° C.; (iii)>50° C.; (iv)>60° C.; (v)>70° C.; (vi)>80° C.; (vii)>90° C.; (viii)>100° C.; (ix)>110° C.; (x)>120° C.; (xi)>130° C.; (xii)>140° C.; (xiii)>150° C.; (xiv)>160° C.; (xv)>170° C.; (xvi)>180° C.; (xvii)>190° C.; (xviii)>200° C.; (xix)>250° C.; (xx)>300° C.; (xxi)>350° C.; (xxii)>400° C.; (xxiii)>450° C.; and (xxiv)>500° C.

4. A method as claimed in claim 1, wherein said mass spectrometer comprises an ion source, a cone-gas cone which surrounds a sampling cone, a first vacuum chamber, a second vacuum chamber separated from said first vacuum chamber by a differential pumping aperture and wherein said method further comprises:

supplying said first gas to said cone-gas cone so that at least some of said first gas interacts with analyte ions passing through said sampling cone into said first vacuum chamber.

5. A method as claimed in claim 4, wherein said ion source is selected from the group consisting of: (i) an Atmospheric Pressure ion source; (ii) an Electrospray ionisation ("ESI") ion source; (iii) an Atmospheric Pressure Chemical Ionisation ("APCI") ion source; (iv) an Atmospheric Pressure Ionisation ("API") ion source; (v) a Desorption Electrospray Ionisation ("DESI") ion source; (vi) an Atmospheric Pressure Matrix Assisted Laser Desorption Ionisation ion source; and (vii) an Atmospheric Pressure Laser Desorption and Ionisation ion source.

6. A method as claimed in claim 4, further comprising:

(i) maintaining said first vacuum chamber at a pressure selected from the group consisting of: (i)<1 mbar; (ii) 1-2 mbar; (iii) 2-3 mbar; (iv) 3-4 mbar; (v) 4-5 mbar; (vi) 5-6 mbar; (vii) 6-7 mbar; (viii) 7-8 mbar; (ix) 8-9 mbar; (x) 9-10 mbar; and (xi)>10 mbar; and (ii) maintaining said second vacuum chamber at a pressure selected from the group consisting of: (i)<1.times.10.sup.−3 mbar; (ii) 1-2.times.10.sup.−3 mbar; (iii) 2-3.times.10.sup.−3 mbar; (iv) 3-4.times.10.sup.−3 mbar; (v) 4-5.times.10.sup.−3 mbar; (vi) 5-6.times.10.sup.−3 mbar; (vii) 6-7.times.10.sup.−3 mbar; (viii) 7-8.times.10.sup.−3 mbar; (ix) 8-9.times.10.sup.−3 mbar; (x) 9-10.times.10.sup.−3 mbar; (xi) 1-2.times.10.sup.−2mbar; (xii) 2-3.times.10.sup.−2 mbar; (xiii) 3-4.times.10.sup.−2 mbar; (xiv) 4-5.times.10.sup.−2 mbar; (xv) 5-6.times.10.sup.−2 mbar; (xvi) 6-7.times.10.sup.−2 mbar; (xvii) 7-8.times.10.sup.−2 mbar; (xviii) 8-9.times.10.sup.−2 mbar; (xix) 9-10.times.10.sup.−2 mbar; (xx) 0.1-0.2 mbar; (xxi) 0.2-0.3 mbar; (xxii) 0.3-0.4 mbar; (xxiii) 0.4-0.5 mbar; (xxiv) 0.5-0.6 mbar; (xxv) 0.6-0.7 mbar; (xxvi) 0.7-0.8 mbar; (xxvii) 0.8-0.9 mbar; (xxxviii) 0.9-1 mbar; and (xxix)>1 mbar.

7. A method as claimed in claim 1, further comprising supplying said first gas to said sampling cone or said cone-gas cone at a flow rate selected from the group consisting of: (i)<10 l/hr; (ii) 10-20 l/hr; (iii) 20-30 l/hr; (iv) 30-40 l/hr; (v) 40-50l/hr; (vi) 50-60 l/hr; (vii) 60-70 l/hr; (viii) 70-80 l/hr;

(ix) 80-90 l/hr; (x) 90-100 l/hr; (xi) 100-110 l/hr; (xii) 110-120 l/hr; (xiii) 120-130 l/hr; (xiv) 130-140 l/hr; (xv) 140-150 l/hr; and (xvi)>150 l/hr.

8. A method of mass spectrometry conducted with a sampling cone and a cone-gas cone comprising:

supplying, without ionization, a first gas as a cone gas or curtain gas to said sampling cone or said cone-gas cone, or supplying, without ionization, a first gas as an additive to a cone gas or curtain gas which is supplied to said sampling cone or said cone-gas cone, so that at least some of said first gas interacts with analyte ions passing through said sampling cone to cool or desolvate said analyte ions, wherein said first gas is selected from the group consisting of: (i) xenon; (ii) uranium hexafluoride ("$UF_6$"); (iii) isobutane ("$C_4H_{10}$"); (iv) krypton; (v) perfluoropropane ("$C_3F_8$"); (vi) hexafluoroethane ("$C_2F_6$"); (vii) hexane ("$C_6H_{14}$"); (viii) benzene ("$C_6H_6$"); (ix) carbon tetrachloride ("$CCl_4$"); (x) iodomethane ("$CH_3I$"); (xi) diiodomethane ("$CH_2I_2$"); (xii) carbon dioxide ("$CO_2$"); (xiii) nitrogen dioxide ("$NO_2$"); (xiv) sulphur dioxide ("$SO_2$"); (xv) phosphorus trifluoride ("$PF_3$"); and (xvi) disulphur decafluoride ("$S_2F_{10}$").

9. A mass spectrometer comprising:

a sampling cone and a cone-gas cone; and a supply device arranged and adapted to supply, in use and without ionization, a first gas as a cone gas or curtain gas which is supplied to said sampling cone or said cone-gas cone, or as an additive to a cone gas or curtain gas which is supplied to said sampling cone or said cone-gas cone, so that at least some of said first gas interacts with analyte ions passing through said sampling cone to cool or desolvate said analyte ions, wherein said first gas comprises sulphur hexafluoride ("$SF_6$").

10. A mass spectrometer as claimed in claim 9, further comprising;

(a) a device for heating said first gas prior to supplying said first gas to said sampling cone or said cone-gas cone; or (b) a device for heating said sampling cone or said cone-gas cone.

11. A mass spectrometer as claimed in claim 9, wherein said mass spectrometer comprises an ion source, a cone-gas cone which surrounds a sampling cone, a first vacuum chamber, a second vacuum chamber separated from said first vacuum chamber by a differential pumping aperture and wherein said supply device is arranged and adapted to supply, in use, said first gas to said cone-gas cone so that at least some of said first gas interacts, in use, with analyte ions passing through said sampling cone into said first vacuum chamber.

12. A mass spectrometer as claimed in claim 11, wherein said ion source is selected from the group consisting of: (i) an Atmospheric Pressure ion source; (ii) an Electrospray ionisation ("ESI") ion source; (iii) an Atmospheric Pressure Chemical Ionisation ("APCI") ion source; (iv) an Atmospheric Pressure Ionisation ("API") ion source; (v) a Desorption Electrospray Ionisation ("DESI") ion source; (vi) an Atmospheric Pressure Matrix Assisted Laser Desorption Ionisation ion source; and (vii) an Atmospheric Pressure Laser Desorption and Ionisation ion source.

13. A mass spectrometer as claimed in claim 11, wherein said mass spectrometer further comprises:

(a) an ion guide arranged in said second vacuum chamber or in a subsequent vacuum chamber downstream of said second vacuum chamber; and (b) a mass filter or mass analyser arranged in said second vacuum chamber or in a subsequent vacuum chamber downstream of said second vacuum chamber; and (c) an ion trap or ion trapping region arranged in said second vacuum chamber or in a subsequent vacuum chamber downstream of said second vacuum chamber; and (d) an ion mobility spectrometer or separator or a Field Asymmetric Ion Mobility Spectrometer arranged in said second vacuum chamber or in a subsequent vacuum chamber downstream of said second vacuum chamber; and (e) a collision, fragmentation or reaction device selected from the group consisting of: (i) a Collisional Induced Dissociation ("CID") fragmentation device; (ii) a Surface Induced Dissociation ("SID") fragmentation device; (iii) an Electron Transfer Dissociation fragmentation device; (iv) an Electron Capture Dissociation fragmentation device; (v) an Electron Collision or Impact Dissociation fragmentation device; (vi) a Photo Induced Dissociation ("PID") fragmentation device; (vii) a Laser Induced Dissociation fragmentation device; (viii) an infrared radiation induced dissociation device; (ix) an ultraviolet radiation induced dissociation device; (x) a nozzle-skimmer interface fragmentation device; (xi) an in-source fragmentation device; (xii) an in-source Collision Induced Dissociation fragmentation device; (xiii) a thermal or temperature source fragmentation device; (xiv) an electric field induced fragmentation device; (xv) a magnetic field induced fragmentation device; (xvi) an enzyme digestion or enzyme degradation fragmentation device; (xvii) an ion-ion reaction fragmentation device; (xviii) an ion-molecule reaction fragmentation device; (xix) an ion-atom reaction fragmentation device; (xx) an ion-metastable ion reaction fragmentation device; (xxi) an ion-metastable molecule reaction fragmentation device; (xxii) an ion-metastable atom reaction fragmentation device; (xxiii) an ion-ion reaction device for reacting ions to form adduct or product ions; (xxiv) an ion-molecule reaction device for reacting ions to form adduct or product ions; (xxv) an ion-atom reaction device for reacting ions to form adduct or product ions; (xxvi) an ion-metastable ion reaction device for reacting ions to form adduct or product ions; (xxvii) an ion-metastable molecule reaction device for reacting ions to form adduct or product ions; and (xxviii) an ion-metastable atom reaction device for reacting ions to form adduct or product ions; and (f) a mass analyser arranged in said second vacuum chamber or in a subsequent vacuum chamber downstream of said second vacuum chamber, said mass analyser being selected from the group consisting of: (i) a quadrupole mass analyser; (ii) a 2D or linear quadrupole mass analyser; (iii) a Paul or 3D quadrupole mass analyser; (iv) a Penning trap mass analyser; (v) an ion trap mass analyser; (vi) a magnetic sector mass analyser; (vii) Ion Cyclotron Resonance ("ICR") mass analyser; (viii) a Fourier Transform Ion Cyclotron Resonance ("FTICR") mass analyser; (ix) an electrostatic or orbitrap mass analyser; (x) a Fourier Transform electrostatic or orbitrap mass analyser; (xi) a Fourier Transform mass analyser; (xii) a Time of Flight mass analyser; (xiii) an orthogonal acceleration Time of Flight mass analyser; and (xiv) a linear acceleration Time of Flight mass analyser.

14. A mass spectrometer comprising: an atmospheric pressure ion source;

a first differential pumping aperture arranged between an atmospheric pressure stage and a first vacuum stage;

a second differential pumping aperture arranged between said first vacuum stage and a second vacuum stage; and a supply device arranged and adapted to supply, in use and without ionization, sulphur hexafluoride ("$SF_6$") or disulphur decafluoride ("$S_2F_{10}$") to a region immediately upstream or a region immediately downstream of said first differential pumping aperture or to said first vacuum stage so that at least some of the sulphur hexafluoride ("$SF_6$") or disulphur decafluoride ("$S_2F_{10}$") interacts with analyte ions passing through the region immediately upstream or the region immediately downstream of said first differential pumping aperture or through said first vacuum stage to cool or desolvate said analyte ions.

15. A mass spectrometer as claimed in claim 14, wherein:

(i) said first vacuum stage is pumped by a rotary pump or a scroll pump; and (ii) said second vacuum stage is pumped by a turbomolecular pump or a diffusion pump; and (iii) said first vacuum stage is maintained at a pressure in the range 1-10 mbar; and (iv) said second vacuum stage is maintained at a pressure in the range $10^{-3}$-$10^{-2}$ mbar or 0.0-0.1 mbar or 0.1-1 mbar or >1 mbar; and (v) said first differential pumping aperture comprises a sampling cone; and (vi) said second differential pumping aperture comprises an extraction lens; and (vii) an ion guide comprising a plurality of elongated electrodes or a plurality of electrodes having apertures through which ions are transmitted in use is provided in the second vacuum stage; and (viii) analyte ions pass, in use, from said first differential pumping aperture to said second differential pumping aperture without being guided by an ion guide comprising a plurality of elongated electrodes or a plurality of electrodes having apertures through which ions are transmitted in use.

16. A mass spectrometer as claimed in claim 14, further comprising a cone-gas cone surrounding said first differential pumping aperture, wherein said supply device is arranged and adapted to supply, in use, sulphur hexafluoride ("$SF_6$") or disulphur decafluoride ("$S_2F_{10}$") to one or more gas outlets or an annular gas outlet which substantially surrounds said first differential pumping aperture, wherein analyte ions passing through said first differential pumping aperture interact with said sulphur hexafluoride or disulphur decafluoride.

17. A method of mass spectrometry comprising:

providing an atmospheric pressure ion source, a first differential pumping aperture arranged between an atmospheric pressure stage and a first vacuum stage and a second differential pumping aperture arranged between said first vacuum stage and a second vacuum stage; and supplying, without ionization, sulphur hexafluoride ("$SF_6$") or disulphur decafluoride ("$S_2F_{10}$") to a region immediately upstream or a region immediately downstream of said first differential pumping aperture or to said first vacuum stage so that at least some of the sulphur hexafluoride ("$SF_6$") or disulphur decafluoride ("$S_2F_{10}$") interacts with analyte ions passing through the region immediately upstream or the region immediately downstream of said first differential pumping aperture or through said first vacuum stage to cool or desolvate said analyte ions.

18. A method as claimed in claim 17, further comprising:

(i) pumping said first vacuum stage by a rotary pump or a scroll pump; and (ii) pumping said second vacuum stage by a turbomolecular pump or a diffusion pump; and (iii) maintaining said first vacuum stage at a pressure in the range 1-10 mbar; and (iv) maintaining said second vacuum stage at a pressure in the range $10^{-3}$-$10^{-2}$ mbar or 0.01-0.1 mbar or 0.1-1 mbar or >1 mbar; and (v) providing an ion guide comprising a plurality of elongated electrodes or a plurality of electrodes having apertures through which ions are transmitted in the second vacuum stage; and (vi) passing analyte ions from said first differential pumping aperture to said second differential pumping aperture without being guided by an ion guide comprising a plurality of elongated electrodes or a plurality of electrodes having apertures through which ions are transmitted.

19. A method as claimed in claim 17, further comprising providing a cone-gas cone surrounding said first differential pumping aperture, said method further comprising:

supplying said sulphur hexafluoride ("$SF_6$") or disulphur decafluoride ("$S_2F_{10}$") to one or more gas outlets or an annular gas outlet which substantially surrounds said first differential pumping aperture, wherein analyte ions passing through said first differential pumping aperture interact with said sulphur hexafluoride or disulphur decafluoride.

* * * * *

UNITED STATES PATENT AND TRADEMARK OFFICE

CERTIFICATE OF CORRECTION

PATENT NO. : 8,471,200 B2
APPLICATION NO. : 12/528203
DATED : June 25, 2013
INVENTOR(S) : Campuzano et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 925 days.

Signed and Sealed this
Seventeenth Day of March, 2015

Michelle K. Lee

Michelle K. Lee
*Director of the United States Patent and Trademark Office*